US006882253B2

(12) United States Patent
Okamura et al.

(10) Patent No.: US 6,882,253 B2
(45) Date of Patent: Apr. 19, 2005

(54) NON-RADIATIVE DIELECTRIC WAVEGUIDE AND MILLIMETER WAVE TRANSMITTING/RECEIVING APPARATUS

(75) Inventors: Takeshi Okamura, Kyoto (JP); Nobuki Hiramatsu, Kyoto (JP)

(73) Assignee: Kyocera Corporation, Kyoto (JP)

( * ) Notice: Subject to any disclaimer, the term of this patent is extended or adjusted under 35 U.S.C. 154(b) by 19 days.

(21) Appl. No.: 09/995,205

(22) Filed: Nov. 26, 2001

(65) Prior Publication Data

US 2002/0101308 A1 Aug. 1, 2002

(30) Foreign Application Priority Data

Nov. 27, 2000 (JP) ..... P2000-360134
Jan. 31, 2001 (JP) ..... P2001-022712

(51) Int. Cl.[7] ..... H01P 3/12

(52) U.S. Cl. ..... 333/239; 333/125; 333/246; 333/248

(58) Field of Search ..... 333/239, 125, 333/137, 246, 248, 249

(56) References Cited

U.S. PATENT DOCUMENTS 4,205,281 A * 5/1980 Nagao ..... 333/1.1
5,246,898 A * 9/1993 Fujimaru et al. ..... 501/135
5,861,782 A * 1/1999 Saitoh ..... 333/239
5,982,255 A 11/1999 Tanizaki et al.
6,094,106 A * 7/2000 Kishino et al. ..... 333/22 R
6,437,663 B1 * 8/2002 Kii et al. ..... 333/137
6,538,530 B1 3/2003 Kii et al.

FOREIGN PATENT DOCUMENTS

| | | | |
|---|---|---|---|
| DE | 196 33 078 | 2/1997 | |
| DE | 100 20 527 | 11/1997 | |
| DE | 100 20 527 | 11/2000 | |
| JP | 57-166701 | 10/1982 | |
| JP | 9-64608 | 3/1997 | |
| JP | 9-102706 | 4/1997 | |
| JP | 11-17412 | 1/1999 | |
| JP | 411308014 A * | 11/1999 | ..... H01P/1/383 |

* cited by examiner

*Primary Examiner*—Robert Pascal
*Assistant Examiner*—Kimberly Glenn
(74) *Attorney, Agent, or Firm*—Hogan&Hartson LLP

(57) ABSTRACT

The invention provides a highly-reliable, low-loss non-radiative dielectric waveguide. According to one aspect of the invention, a non-radiative dielectric waveguide comprises parallel planar conductors arranged at an interval of half or below of a high-frequency signal wavelength, and a dielectric strip interposed between the parallel planar conductors. The dielectric strip has a 0.01 to 0.3 mm-wide chamfer formed at its edge portion in a high-frequency signal transmission direction. According to another aspect of the invention, a non-radiative dielectric waveguide comprises parallel planar conductors arranged at an interval of half or below of a high-frequency signal wavelength, and a dielectric strip interposed between the parallel planar conductors. The dielectric strip is made of a ceramics having an open pore ratio of 5% or less.

19 Claims, 6 Drawing Sheets

NON-RADIATIVE DIELECTRIC WAVEGUIDE AND MILLIMETER WAVE TRANSMITTING/RECEIVING APPARATUS

BACKGROUND OF THE INVENTION

1. Field of the Invention

The present invention relates to a non-radiative dielectric waveguide used in a high-frequency band, such as a millimeter wave band, and more particularly to a non-radiative dielectric waveguide suitably used for a millimeter wave integrated circuit or the like. The invention also relates to a millimeter wave transmitting/receiving apparatus of non-radiative dielectric waveguide type, such as a millimeter wave integrated circuit or a millimeter wave radar module.

2. Description of the Related Art

A conventional non-radiative dielectric waveguide (hereafter referred to as an NRD guide) S11 is shown in FIG. 8. In the NRD guide S11 shown in FIG. 8, a dielectric strip 202 is interposed between a pair of parallel planar conductors 201 and 203 arranged at an interval d of $\lambda/2$ or below of a wavelength $\lambda$ of an electromagnetic wave (high-frequency signal) propagating through the air at the usage frequency. This arrangement allows an electromagnetic wave to propagate along the dielectric strip 202. That is, this construction conforms to the principle of operation that a radiant wave is suppressed by the cut-off effects exerted by the parallel planar conductors 201 and 203.

The NRD guide S11 is operated in two electromagnetic-wave transmission modes, one of which is the LSM mode while the other is the LSE mode. In general, the LSM mode is put into wider use because of its small transmission loss. Moreover, as an NRD guide of another type, there is known an NRD guide S12 as shown in FIG. 9 that is provided with a dielectric strip 214 in a curved shape. In this construction, an electromagnetic wave is allowed to propagate easily in a curve, so that miniaturization of a millimeter wave integrated circuit or highly flexible circuit design can be implemented.

Note that, in FIGS. 8 and 9, the upper parallel planar conductor 203 is partially cut away and another parallel planar conductor 213 is indicated by a broken line, so that their inner portions come into view. Numerals 201 and 211 represent lower parallel planar conductors.

As materials for the dielectric strips 202 and 214 of the NRD guides S11 and S12, resin materials having a relative dielectric constant of 2 to 4 have conventionally been used, such as Teflon (Trademark of DuPont; polytetrafluoroethylene) or polystyrene, in view of its easy processability and lower loss.

However, in the NRD guide realized by using a dielectric strip formed of a conventionally-used dielectric material having a relative dielectric constant of 2 to 4, such as Teflon or polystyrene, there is a transmission loss at a curved portion (to be simply called bending loss) or a transmission loss in a strip conjugating portion is great. This makes it impossible to provide a sharp curved portion. Moreover, even in a case where a gently-curved portion is formed, its radius of curvature needs to be determined precisely. Further, a frequency band width in which transmission can be achieved with lower bending loss is insufficient, for example, made as narrow as about 1 to 2 GHz in the vicinity of 60 GHz. This is because, in the NRD guide S11 or S12 employing a dielectric material having a relative dielectric constant of 2 to 4, since the dispersion curves of the LSM mode and LSE mode are very close to each other, part of electromagnetic waves of the LSM mode is converted into LSE mode, which results in an increase in transmission loss.

There is also known an NRD guide employing ceramics having a relative dielectric constant of about 10, such as an alumina ($Al_2O_3$) ceramics, as a material for the dielectric strips 202 and 214. However, such an NRD guide cannot be used in a high-frequency band of not lower than 50 GHz without making the width of the dielectric strips 202 and 214 extremely narrow, and is thus impractical in terms of processability and mountability.

Moreover, in an NRD guide realized by using a dielectric strip formed of a conventionally-used resin material such as Teflon, the dielectric strip and the parallel planar conductor cannot be bonded to each other with ease. Consequently, the dielectric strip is positionally deviated due to vibration or difference in thermal expansion, which results in malfunction.

Further, as disclosed in Japanese Unexamined Patent Publication JP-A 57-166701 (1982), the sectional configuration of the dielectric strip is not limited to a rectangular shape, but is required to be geometrically symmetric with respect to the shape of the parallel planar conductor in accordance with the principle of operation. In this respect, in an NRD guide realized by using a dielectric strip formed of a conventionally-used resin material such as Teflon, the dielectric strip is positionally deviated and its symmetrical configuration becomes deformed due to vibration or difference in thermal expansion, which results in malfunction.

If the dielectric strip exhibits an unduly small relative density, the dielectric constant is smaller than the material property value. This makes it impossible to obtain intended transmission characteristics. Moreover, in this case, the open pore ratio is increased, and therefore impurities, which are generated during the process steps for the dielectric strip, are attached to the strip surface, and the strip surface adsorbs moisture due to humidity of atmosphere. This causes deterioration of the transmission characteristics. Further, during the process steps, the dielectric strip suffers from a burr or chip, which makes difficult formation of the symmetrical configuration. Still further, in a case where the dielectric strip is secured with adhesive, the adhesive exhibiting large dielectric loss finds its way into the open pore portion or chipping of the dielectric strip that is a cause of a decrease in density. This causes attenuation of high-frequency signals, which results in an undesirable increase in transmission loss.

Particularly, in a case where a plurality of dielectric strip portions are arranged at narrow spaces and electromagnetically coupled to one another so as to form a single set of a long dielectric strip, the intrusion of adhesive exhibiting large dielectric loss between the dielectric strip portions causes significant deterioration in transmission efficiency of high-frequency signals, or leads to generation of discontinuities in high-frequency signal transmission.

SUMMARY OF THE INVENTION

The invention has been made in view of the above-described problems, and accordingly its object is to provide a high-performance NRD guide which offers excellent reliability and suffers little from high-frequency signal transmission loss, and in which, since conversion of an electromagnetic wave of an LSM mode into an LSE mode is minimized, a sharp curved portion capable of dealing with a wide usage frequency range despite having a smaller radius of curvature can be formed in the dielectric strip, and consequently the millimeter wave integrated circuit in which it is incorporated can be made compact. Another object of the invention is to realize, by using such an NRD guide, a compact millimeter wave transmitting/receiving apparatus which incurs lower loss in high-frequency signal transmission.

The invention provides a non-radiative dielectric waveguide comprising:

a pair of parallel planar conductors arranged at an interval of half or below of a high-frequency signal wavelength; and a dielectric strip interposed between the parallel planar conductors, the dielectric strip having a 0.01 to 0.3 mm-wide chamfer formed at an edge portion in a transmission direction of the dielectric strip.

According to the invention, in the non-radiative dielectric waveguide, the dielectric strip has a 0.01 to 0.3 mm-wide chamfer formed at its edge portion in a direction in which high-frequency signals are transmitted. Thus, when one surface of the dielectric strip facing to the parallel planar conductor is bonded to the parallel planar conductor with adhesive, the adhesive spreads over the chamfer, resulting in an increase in the bonding area. This allows the dielectric strip to be bonded firmly to the parallel planar conductor, thereby obtaining excellent durability. Moreover, the adhesive existing in the chamfer serves to alleviate adverse effects such as thermal expansion or shock. This helps protect the central portion of the dielectric strip, onto which electric fields of high-frequency signals (electromagnetic waves) to be transmitted are concentrated, against deformation. Consequently, transmission loss in high-frequency signals can be effectively suppressed. In this way, a high-performance non-radiative dielectric waveguide can be realized that is highly reliable and incurs lower loss.

In the invention, it is preferable that the chamfer is formed as a flat surface, and one width of the chamfer corresponding to a surface of the dielectric strip facing to the parallel planar conductor is made larger than the other width corresponding to a side surface of the dielectric strip.

In the invention, it is preferable that the chamfer is formed as a convexly-curved surface, and one width of the chamfer corresponding to the surface of the dielectric strip facing to the parallel planar conductor is made larger than the other width corresponding to the side surface of the dielectric strip.

The invention provides a non-radiative dielectric waveguide comprising:

a pair of parallel planar conductors arranged at an interval of half or below of a high-frequency signal wavelength; and a dielectric strip interposed between the parallel planar conductors, the dielectric strip being made of a ceramics having an open pore ratio of 5% or less.

In the invention, it is preferable that the dielectric strip has an open pore ratio of 3% or less.

In the non-radiative dielectric waveguide embodying the invention, the open pore ratio of the dielectric strip is set at 5% or less. This prevents, during the process steps for the dielectric strip, impurities, which are generated during the process, from being attached to the strip surface, and also prevents the strip surface from adsorbing moisture due to humidity of atmosphere. Consequently, transmission loss in high-frequency signals is minimized. Eventually, a high-performance non-radiative dielectric waveguide can be realized that is highly reliable and incurs lower loss.

In the invention, it is preferable that the dielectric strip is formed of a ceramics including a complex oxide comprising Mg, Al and Si as a main component and having a Q value of 1000 or above at a measured frequency of 60 GHz.

According to the invention, it is possible to fabricate an NRD guide which is excellent in terms of easy processability, higher degree of flexibility in manufacturing, and lower transmission loss in high-frequency signals, and in which conversion of an electromagnetic wave of an LSM mode into an LSE mode is minimized and thus a sharp curved portion capable of dealing with a wide usage frequency range despite having a smaller radius of curvature can be formed in the dielectric strip, and consequently the millimeter wave integrated circuit or the like in which it is incorporated can be made compact. Moreover, in this construction, a multiplicity of configuratively accurate and stable dielectric strips can be easily formed by using ceramics. This helps reduce the manufacturing cost. Further, since the dielectric strip has a relative dielectric constant greater than that of a resin material such as Teflon, a jig for supporting the dielectric strip or circuit substrate made of such a resin material may be arranged in the vicinity of the dielectric strip with little influence thereon.

In the invention, it is preferable that the composition of the complex oxide by mole ratio is expressed by the following formula: $xMgO.yAl_2O_3.zSiO_2$ (wherein x, y and z are numbers satisfying the x+y+z=100 mole %, x representing 10 to 40 mole %, y representing 10 to 40 mole %, and z representing 20 to 80 mole %).

According to the invention, it is possible to fabricate an NRD guide in which transmission loss is further reduced and an inexpensive but configuratively accurate dielectric strip is provided.

In the invention, it is preferable that the dielectric strip has a relative dielectric constant of 4.5 to 8.

In the invention, it is preferable that the dielectric strip is made of a cordierite ceramics.

The invention provides a millimeter wave transmitting/receiving apparatus comprising:

a pair of parallel planar conductors arranged at an interval of half or below of a millimeter wave signal wavelength;

a first dielectric strip having at its one end a high-frequency diode oscillator, the first dielectric strip propagating a millimeter wave signal outputted from the high-frequency diode oscillator;

a variable capacitance diode for outputting the millimeter wave signal as a frequency modulated transmission millimeter wave signal, by periodically controlling a bias voltage of the variable capacitance diode, the variable capacitance diode being arranged such that a direction in which the bias voltage is applied coincides with a direction of an electric field of the millimeter wave signal;

a second dielectric strip, one end of the second dielectric strip being disposed near the first dielectric strip so as to be electromagnetically coupled, or being joined to the first dielectric strip, the second dielectric strip propagating part of the millimeter wave signal toward a mixer;

a circulator having a first connection portion, a second connection portion, and a third connection portion arranged at predetermined spacings along a perimeter of a ferrite disk arranged in parallel to the parallel planar conductors, the connection portions serving as input/output terminals for the millimeter wave signal, the circulator outputting the millimeter wave signal inputted into one of the connection portions from another connection portion that is adjacent in clockwise or counter-clockwise circulation within a plane of the ferrite disk, the first connection portion being connected to an output terminal of the millimeter wave signal of the first dielectric strip;

a third dielectric strip for propagating the millimeter wave signal, the third dielectric strip being joined to the second connection portion of the circulator and having a transmitting/receiving antenna disposed at its front end;

a fourth dielectric strip for propagating a received wave that is received by the transmitting/receiving antenna, propagated along the third dielectric strip, and outputted from the third connection portion of the circulator, toward the mixer; and a mixer portion for generating an intermediate frequency signal by mixing part of the millimeter wave signal and a received wave, the mixer being made by placing an intermediate portion of the second dielectric strip near an intermediate portion of the fourth dielectric strip so that the second and fourth dielectric strips are electromagnetically coupled to, or joined to each other, wherein the first, second, third, and fourth dielectric strips; the variable capacitance diode; the circulator; and the mixer portion are interposed between the parallel planar conductors, and wherein, of the first to fourth dielectric strips, at least one is a non-radiative dielectric waveguide embodying the invention.

The invention provides a millimeter wave transmitting/receiving apparatus comprising:

a pair of parallel planar conductors arranged at an interval of half or below of a high-frequency signal wavelength;

a first dielectric strip having at its one end a high-frequency diode oscillator, the first dielectric strip propagating a millimeter wave signal outputted from the high-frequency diode oscillator;

a variable capacitance diode for outputting the millimeter wave signal as a frequency modulated transmission millimeter wave signal, by periodically controlling a bias voltage of the variable capacitance diode, the variable capacitance diode being arranged such that a direction in which the bias voltage is applied coincides with a direction of an electric field of the millimeter wave signal;

a second dielectric strip, one end of the second dielectric strip being disposed near the first dielectric strip so as to be electromagnetically coupled, or being joined to the first dielectric strip, the second dielectric strip propagating part of the millimeter wave signal toward a mixer;

a circulator having a first connection portion, a second connection portion, and a third connection portion arranged at predetermined spacings along a perimeter of a ferrite disk arranged in parallel to the parallel planar conductors, the connection portions serving as input/output terminals for the millimeter wave signal, the circulator outputting the millimeter wave signal inputted into one of the connection portions from another connection portion that is adjacent in clockwise or counter-clockwise circulation within a plane of the ferrite disk, the first connection portion being connected to an output terminal of the millimeter wave signal of the first dielectric strip;

a third dielectric strip for propagating the millimeter wave signal, the third dielectric strip being connected to the second connection portion of the circulator and having a transmitting antenna disposed at its front end;

a fourth dielectric strip having at its front end a receiving antenna and having its other end a mixer;

a fifth dielectric strip connected to the third connection portion of the circulator, the fifth dielectric strip propagating a millimeter wave signal received and mixed with the transmitting antenna and attenuating the millimeter wave signal at a non-reflective terminal end disposed at a front end of the fifth dielectric strip; and a mixer portion for generating an intermediate frequency signal by mixing part of the millimeter wave signal and a received wave, the mixer being made by placing an intermediate portion of the second dielectric strip near an intermediate portion of the fourth dielectric strip so that the second and fourth dielectric strips are electromagnetically coupled to, or joined to each other, wherein the first, second, third, fourth, and fifth dielectric strips; the variable capacitance diode; the circulator; and the mixer portion are interposed between the parallel planar conductors, and wherein, of the first to fifth dielectric strips, at least one is a non-radiative dielectric waveguide embodying the invention.

According to the invention, in a millimeter wave transmitting/receiving apparatus of the type that employs a transmitting/receiving antenna or the type in which a transmitting antenna and a receiving antenna are provided independently, of all the dielectric strips provided therein, at least one consists of a dielectric strip embodying the invention. This helps minimize conversion of an electromagnetic wave of an LSM mode into an LSE mode and thus make it possible to form in the dielectric strip a sharp curved portion which is capable of dealing with a wide usage frequency range despite having a smaller radius of curvature. Consequently, the advantages of the millimeter wave transmitting/receiving apparatus is its broad usage frequency band, compactness, easy processability, and higher degree of flexibility in manufacturing. Moreover, in the millimeter wave transmitting/receiving apparatus of the type in which a transmitting antenna and a receiving antenna are provided independently, the transmission millimeter wave signal is not fed through the circulator into the mixer, and as a result, the noise in received signals can be reduced and the detection distance can be increased, so that the transmission characteristics of the millimeter wave signal improve.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 8:
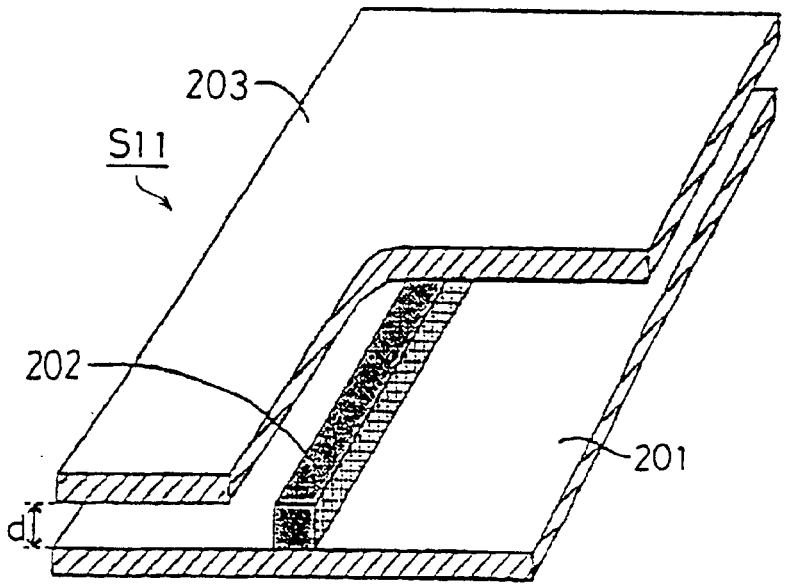
FIG. 8 PRIOR ART
FIG. 8 is a perspective view showing the inner structure of a conventional NRD guide.
Figure 9:
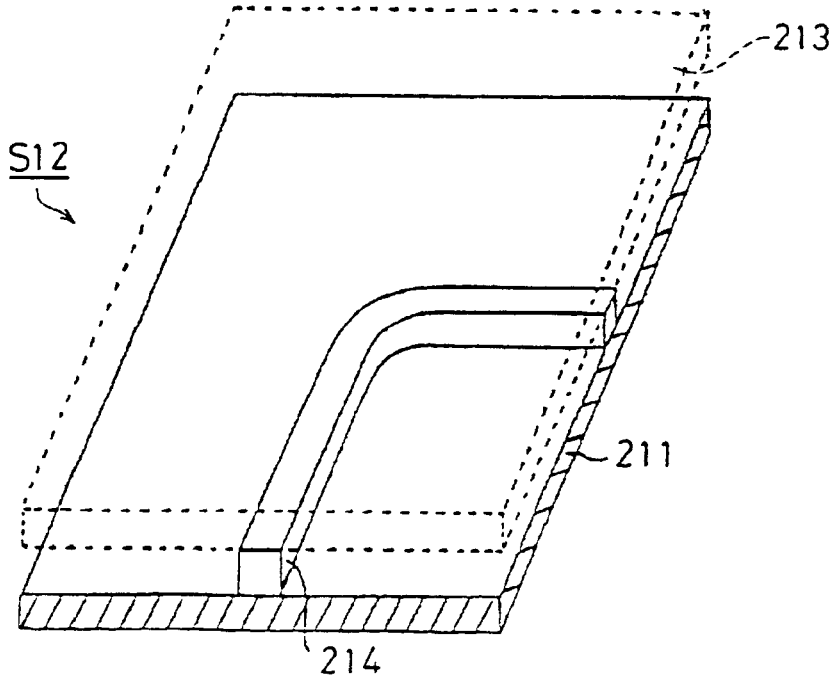
FIG. 9 PRIOR ART
FIG. 9 is a perspective view showing the inner structure of another conventional NRD guide.

Hereinafter, a non-radiative dielectric waveguide (NRD guide) S1 embodying the invention will be described in detail. The NRD guide S1 of the invention has basically the same structure as the NRD guide S11 shown in FIG. 8, and the description thereof will be made with reference to FIG. 1. In the figure, the NRD guide S1 includes a pair of parallel planar conductors 1 and 3 and a dielectric strip 2. The parallel planar conductors 1 and 3 are arranged at an interval d of half or below of a high-frequency signal wavelength λ. The dielectric strip 2 is interposed and sandwiched between the parallel planar conductors 1 and 3. That is, the NRD guide S1 is constructed such that the parallel planar conductors 1 and 3 are arranged on the lower and upper sides of the dielectric strip 2, respectively. The NRD guide S1 may also be constructed such that the dielectric strip 2 is divided into a plurality of dielectric strip portions and the dielectric strip portions are arranged with their end faces spacedly opposed to each other. Note that the wavelength λ corresponds to a wavelength of a high-frequency signal propagating through the air at the usage frequency. In view of high electric conductivity and excellent processability, the parallel planar conductors 1 and 3 for use in the NRD guide S1 may be metal plates that are made of a material such as Cu, Al, Fe, SUS (stainless steel), Ag, Au, or Pt and processed by forging, casting, die-casting, or grinding, or may be such structured plates that an insulative plate made of ceramics, resin, or the like is coated with a conductor layer made of any of these metals.

Figure 6A:
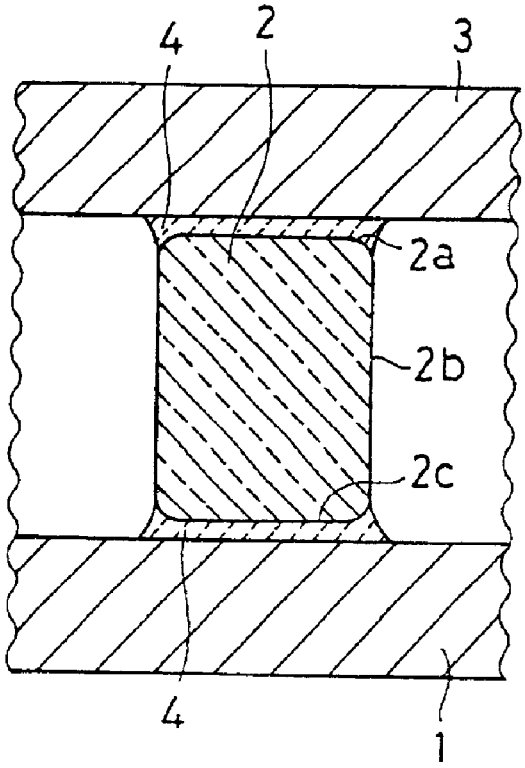
FIG. 6A is a partial sectional view of the NRD guide of the invention, illustrating its dielectric strip portion sectioned in a direction perpendicular to a high-frequency signal transmission direction.
Figure 6B:
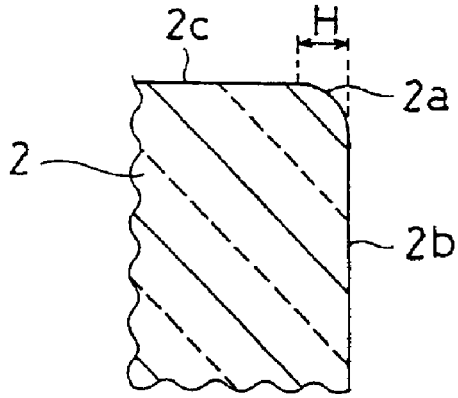
FIG. 6B is a partial sectional view of a chamfer formed in the dielectric strip.

In the invention, as shown in FIGS. 6A and 6B, the dielectric strip 2 has a chamfer 2*a* having a width H of 0.01 to 0.3 mm formed in its edge portion extending in a transmission direction. Note that FIG. 6A is a partial sectional view illustrating the dielectric strip 2 and the parallel planar conductors 1 and 3 that are sectioned in a direction perpendicular to the high-frequency signal transmission direction, and FIG. 6B is a partial sectional view illustrating the chamfer 2*a* of the dielectric strip 2. If the width H of the chamfer 2*a* is less than 0.01 mm, it is difficult to form such a narrow chamfer 2*a*. By contrast, if the width H of the chamfer 2*a* exceeds 0.3 mm, a surface 2*c* of the dielectric strip 2 opposed to the parallel planar conductors 1 and 3 has an unduly small surface area. This leads to an undesirable reduction in the adhesion strength of the dielectric strip 2. Moreover, in this case, adhesive 4 is present in the vicinity of a central portion of a side surface 2*b*, onto which electric fields are concentrated, of the dielectric strip 2. The adhesive 4 exhibits large dielectric loss, and thus causes attenuation of high-frequency signals, resulting in large transmission loss in high-frequency signals. To maintain adequate adhesion strength in the dielectric strip 2 and to effectively suppress transmission loss in high-frequency signals, the chamfer 2*a* needs to have a width of 0.3 mm or less.

Note that the electric fields of the transmitted high-frequency signals (electromagnetic waves) are concentrated onto the central portion of the side surface 2*b* of the dielectric strip 2, and electric fields traveling in a direction perpendicular to the inner surfaces of the parallel planar conductors 1 and 3 are concentrated onto the side surface 2*b* of the dielectric strip 2 located near the parallel planar conductors 1 and 3. Therefore, it is preferable to use air exhibiting small dielectric loss as a dielectric substance for the side surface 2*b* of the dielectric strip 2. By designing the chamfer 2*a* in the way according to the invention, adequate adhesion strength can be maintained in the dielectric strip 2, and the side surface 2*b*, which is exposed to the air, can be formed over as large an area as possible in the dielectric strip 2, thereby minimizing transmission loss in high-frequency signals.

The width of the chamfer 2*a* should preferably be set at 0.02 to 0.25 mm, more preferably, 0.05 to 0.2 mm. The chamfer 2*a* may also be formed at the edge portion of the dielectric strip 2 extending in a direction perpendicular to high-frequency signal transmission direction, i.e. at the parallel planar conductor (1 and 3)—side edge portion of the input/output end surface of the dielectric strip 2. Also in this case, improved bonding strength can be attained.

Figure 7A:
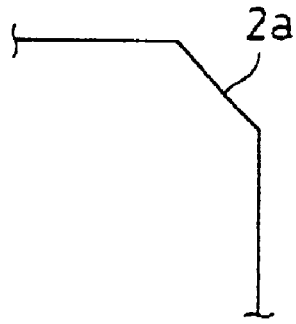
FIGS. 7A to 7D are partial sectional views showing various types of chamfers formed in the dielectric strip according to the invention.
Figure 7B:
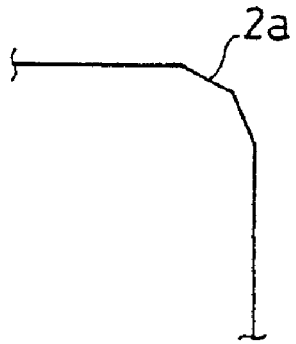
Figure 7C:
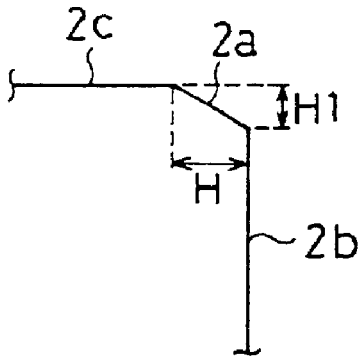
Figure 7D:
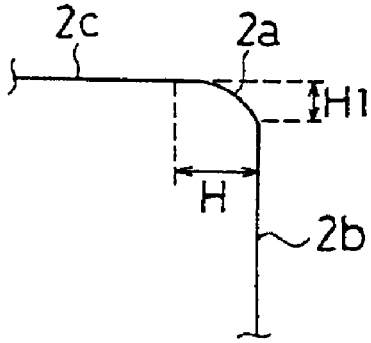

FIGS. 7A to 7D show various types of chamfers 2*a*. In FIG. 7A, the chamfer 2*a* is shaped in the form of a linear C surface, i.e. a corner surface consisting of a single plane. This is easily producible. In FIG. 7B, the chamfer 2*a* consists of a plurality of linear surfaces, i.e. a plurality of planes. In this case, occurrence of chipping at the edge of the chamfer 2*a* is successfully prevented. In FIG. 7C, the C-surface chamfer 2*a* is designed such that a width H corresponding to the surface 2*c* facing to the parallel planar conductor is made larger than a width H1 corresponding to the side surface 2*b*. In this case, the side surface 2*b* can be formed over as large an area as possible in the dielectric strip 2, thereby minimizing transmission loss in high-frequency signals. In FIG. 7D, the convexly-curved chamfer 2*a* is designed such that a width H corresponding to the surface 2*c* facing to the parallel planar conductor is made larger than a width H1 corresponding to the side surface 2*b*. In this case, the side surface 2*b* can be formed over as large an area as possible in the dielectric strip 2, thereby minimizing transmission loss in high-frequency signals. Moreover, occurrence of chipping at the edge of the chamfer 2*a* is successfully prevented.

In this invention, it is preferable that the dielectric strip 2 is made of a ceramics including a complex oxide comprising Mg, Al, and Si as a main component and having a Q value of 1000 or above at a usage frequency of 60 GHz. The ceramics has a relative dielectric constant of about 4.5 to 8. If the relative dielectric constant is less than 4.5, as described previously, conversion of an electromagnetic wave of an LSM mode to an LSE mode is unduly great. By contrast, if the relative dielectric constant is greater than 8, to be used in a high frequency range of 50 GHz or above, the dielectric strip 2 needs to have a markedly narrow width. This makes the process of the dielectric strip 2 difficult, resulting in deterioration in the configuration accuracy and strength. The ceramics, which includes a complex oxide comprising Mg, Al, and Si as a main component and has a Q value of 1000 or above at a usage frequency of 60 GHz, exhibits enough low loss to apply for a dielectric waveguide used in a frequency of 60 GHz included in microwave bands and millimeter wave bands in recent years.

The ceramics formed into the dielectric strip 2 includes a complex oxide comprising Mg, Al, and Si as a main component, and the composition of the complex oxide by mole ratio is expressed by the following formula: $xMgO.yAl_2O_3.zSiO_2$, wherein x, y and z are numbers satisfying the x+y+z=100 mole %, x representing 10 to 40 mole %, y representing 10 to 40 mole %, and z representing 20 to 80 mole %.

The composition of the main component of the ceramics (dielectric porcelain composition) used for the dielectric strip 2 of the invention is limited to the above range. The reason is as follows. Firstly, in the above formula, x falls in the range of 10 to 40 mole %. If x is less than 10 mole %, it is impossible to obtain a good sintered product. By contrast, if x exceeds 40 mole %, the relative dielectric constant becomes unduly high. In order to increase the Q value at 60 GHz to 2000 or above, x should preferably be in the range of 15 to 35 mole %.

Secondly, y falls in the range of 10 to 40 mole %. If y is less than 10 mole %, it is impossible to obtain a good sintered product. If y exceeds 40 mole %, the relative dielectric constant becomes unduly high. In order to increase the Q value at 60 GHz to 2000 or above, y should preferably be in the range of 17 to 35 mole %.

Thirdly, z falls in the range of 20 to 80 mole %. If z is less than 20 mole %, the relative dielectric constant becomes unduly high. If z exceeds 80 mole %, it is impossible to obtain a good sintered product and the Q value becomes low. In order to increase the Q value at 60 GHz to 2000 or above, z should preferably be in the range of 30 to 65 mole %.

Values of x, y, and z indicating the mole % of xMgO, $yAl_2O_3$, and $zSiO_2$ can be determined by means of EPMA (Electron Probe Micro Analysis) method, XRD (X-ray Diffraction) method, or the like.

Moreover, the ceramics (dielectric porcelain composition) used for the dielectric strip 2 of the invention contains cordierite ($2MgO.2Al_2O_3.5SiO_2$) as a main crystal phase, but depending upon its composition, phases such as mullite ($3Al_2O_3.2SiO_2$), spinel ($MgO.Al_2O_3$), protoenstatite (a kind of steatite containing magnesium metasilicate ($MgO.SiO_2$) as a main component), clinoenstatite (a kind of steatite containing magnesium metasilicate ($MgO.SiO_2$) as a main component), forsterite ($2MgO.SiO_2$), cristobalite (a kind of silica ($SiO_2$)), tridymite (a kind of silica ($SiO_2$)), or sapphirine (a kind of silicate of Mg or Al) maybe precipitated as sub-crystal phases. Note that the dielectric porcelain composition of the invention may contain only cordierite as a crystal phase.

The dielectric porcelain composition used for the dielectric strip 2 of the invention is prepared as follows. As powder materials in use, for example, $MgCO_3$, $Al_2O_3$, and $SiO_2$ are used. These powder materials are subjected to weighing at predetermined ratios. After being wet-mixed and dried, the powder materials are calcined in the air at a temperature of 1100 to 1300° C., and are thereafter pulverized. The resultant powder is added with a suitable amount of resin binder to be formed into a molded product. The molded product is then fired in the air at a temperature of 1300 to 1450° C. Eventually, a dielectric porcelain composition is obtained.

The powder materials consisting of Mg, Al, and Si may contain inorganic compounds such as an oxide, a carbonate, and an acetate or organic compounds such as organic metals, so long as these materials may form oxides by firing.

Note that the dielectric porcelain composition of the invention includes a complex oxide comprising Mg, Al and Si as a main component and has a Q value of 1000 or above at a frequency of 60 GHz. However, as far as these characteristics are not impaired, the dielectric porcelain composition may contain impurities of milling ball or the powder materials, or may be added with other components for the purpose of controlling the sintering temperature range and enhancing the mechanical characteristics. The examples of the components to be added include: a rare-earth element compound; oxides such as Ba, Sr, Ca, Ni, Co, In, Ga, or Ti; and non-oxides such as nitride, for example silicon nitride. These components may be added singly or in combination.

In the invention, "high-frequency band" corresponds to the microwave and millimeter wave bands of several 10 GHz to several 100 GHz, such the high-frequency band of 30 GHz or more, more preferably 50 GHz or more, and most preferably 70 GHz or more.

As another materials for the dielectric strip 2, resin materials such as Teflon, polystyrene, glassepoxyresin, or an alumina ceramics, a glass ceramics, or a forsterite ceramics may be used. In particular, a cordierite ceramics is desirable in terms of dielectric characteristics, processability, strength, miniaturization, and reliability.

In the invention, in a case where the dielectric strip 2 is made of a ceramics, its open pore ratio is set at 5% or less.

The reason for limiting the open pore ratio of the dielectric strip 2 to 5% or less is as follows. If the open pore ratio exceeds 5%, the pores included in the dielectric strip 2 absorb water, which leads not only to deterioration in the transmission characteristics but also to unevenness of the density distribution within the dielectric strip 2. This causes unevenness of dielectric constants in the dielectric strip 2, resulting in deterioration in the transmission characteristics. Furthermore, as the density is decreased, the strip strength becomes low and it is inevitable that the dielectric strip becomes deformed. This degrades the transmission characteristics. Accordingly, the open pore ratio should preferably be set at 3% or less, more preferably, 2% or less.

Although the lower limit of the open pore ratio is not specified, the smaller, the better.

Note that the open pore ratio (%) may be measured by the Archimedes' method. Specifically, in accordance with the technique of JISC-2141, it can be calculated from the following formula: 100×(water-saturated weight−dry weight)/(water-saturated weight−in-water weight).

The NRD guide S1 of the invention is designed for use in a wireless LAN or a millimeter wave radar for automobiles. In this construction, for example, millimeter waves are irradiated toward obstacles or other automobiles near the automobile. Then, an intermediate frequency signal is obtained by merging a reflected wave with the original millimeter wave. By analyzing this intermediate frequency signal, it is possible to measure the distance to the obstacle or the other automobile and the travel speed thereof.

As described thus far, the invention provides a highly-reliable, high-performance, and compact NRD guide. In this NRD guide, since the dielectric strip is made of a ceramics having a relative dielectric constant lower than that of a conventional material such as an alumina ceramics, conversion of an electromagnetic wave of an LSM mode into an LSE mode can be minimized. As a result, high-frequency signal loss can be suppressed.

Figure 2:
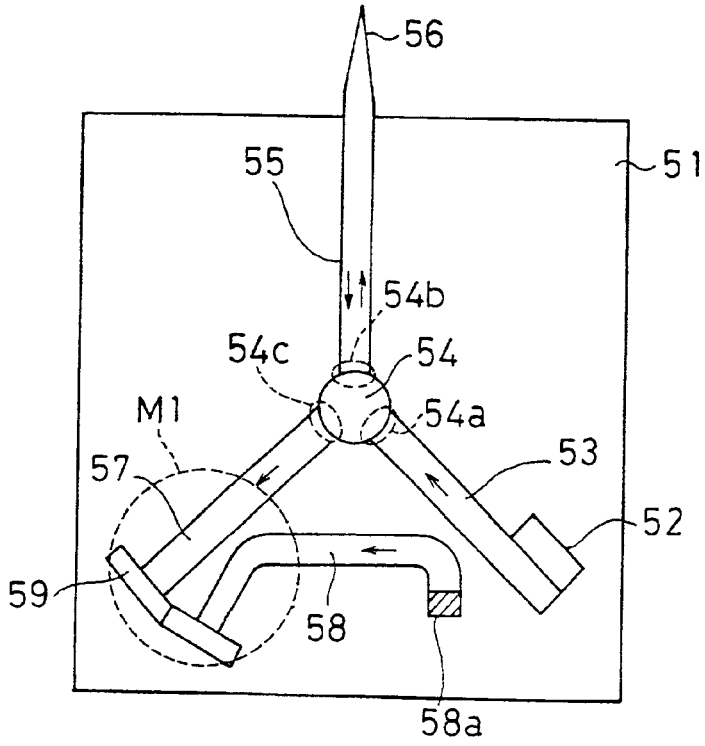
FIG. 2 is a plan view showing one embodiment of a millimeter wave radar having the NRD guide according to the invention.
Figure 3:
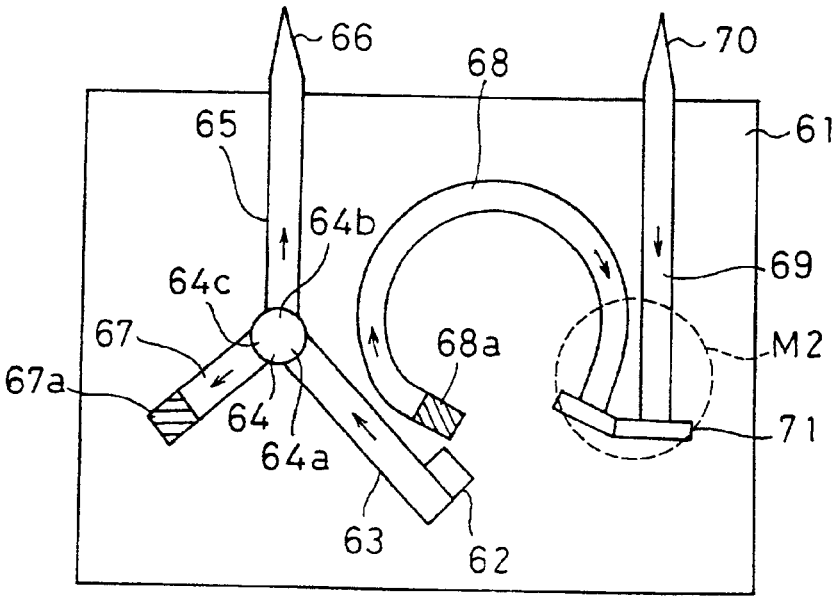
FIG. 3 is a plan view showing another embodiment of the millimeter wave radar having the NRD guide according to the invention.

Next, a description will be given below as to a millimeter wave transmitting/receiving apparatus employing the NRD guide according to the invention. FIGS. 2 and 3 are views of a millimeter wave radar as the millimeter wave transmitting/receiving apparatus of the invention, with FIG. 2 showing a plan view of a millimeter wave radar in which a transmitting antenna and a receiving antenna are formed integrally with each other, and FIG. 3 showing a plan view of a millimeter wave radar in which a transmitting antenna and a receiving antenna are provided independently.

In FIG. 2, the millimeter wave radar includes: a pair of parallel planar conductors 51; a millimeter wave signal oscillator 52; a first dielectric strip 53; a circulator 54; a third dielectric strip 55; a transmitting/receiving antenna 56; a fourth dielectric strip 57; a second dielectric strip 58; a mixer 59; and a mixer portion M1. In FIG. 2, for easy understanding, only one of the parallel planar conductors 51 is illustrated, but the other one has been omitted from the figure. The parallel planar conductor 51 corresponds to the parallel planar conductors 1 and 3 shown in FIG. 1. The millimeter wave signal oscillator 52 is built as a voltage-controlled oscillator. The millimeter wave signal oscillator 52 is provided at one end of the first dielectric strip 53 and has a high-frequency diode oscillator. Moreover, a variable capacitance diode is arranged in the first dielectric strip 53 near the high-frequency diode, such that a direction in which a bias voltage is applied (bias voltage application direction) coincides with the electric field direction of the high-frequency signal. In the millimeter wave signal oscillator 52, by periodically controlling the bias voltage of the variable capacitance diode, a triangular or sinusoidal wave is formed, and thereby the millimeter wave signal fed from the high-frequency diode oscillator 52 is outputted as a frequency-modulated transmission millimeter wave signal.

The first dielectric strip 53 has at its one end a high-frequency diode oscillator 52 to transmit the transmission millimeter wave signal obtained by modulating the millimeter wave signal outputted from the high-frequency diode oscillator 52. The circulator 54 is made for example of a ferrite disk and has a first, a second, and a third connection portion 54*a*, 54*b*, and 54*c* that are respectively connected to the first, third, and fourth dielectric strips 53, 55, and 57. The third dielectric strip 55 is connected to the second connection portion 54*b* of the circulator 54 and has a transmitting/receiving antenna 56 disposed at its front end. The third dielectric strip 55 transmits the millimeter wave signals. The transmitting/receiving antenna 56 is realized by, for example, tapering the front end of the third dielectric strip 55.

For example, the transmitting/receiving antenna 56 may be built as a horn antenna which inputs and outputs high-frequency signals through a through hole formed in the parallel planar conductors 51. The horn antenna is disposed on the outer surface of the parallel planar conductor 51 via a metal waveguide connected to the through hole.

The fourth dielectric strip 57 transmits received waves that have been received by the transmitting/receiving antenna 56, propagated along the third dielectric strip 55, and outputted from the third connection portion 54*c* of the circulator 54, toward the mixer 59. The second dielectric strip 58 is arranged near the first dielectric strip 53 so that its one end is electromagnetically coupled to the first dielectric strip 53. The second dielectric strip 58 transmits part of the millimeter wave signal toward the mixer 59. A non-reflective terminal end 58*a* (terminator) is arranged at one end of the second dielectric strip 58 that is away from the mixer 59. The mixer portion M1 is realized by placing an intermediate portion of the second dielectric strip 58 near an intermediate portion of the fourth dielectric strip 57 so that the second and fourth dielectric strips are electromagnetically coupled to each other. The mixer portion M1 generates an intermediate frequency signal by mixing part of the millimeter wave signal and a received wave.

According to the invention, the circulator 54 includes a first connection portion 54*a*, a second connection portion 54*b*, and a third connection portion 54*c* serving as input/output terminals for millimeter wave signals. The connection portions are arranged along the perimeter of the ferrite disk such that they are spaced a predetermined distance apart, for example, spaced 120° apart with respect to the center of the ferrite disk. The pair of ferrite disks are parallely arranged between the pair of parallel planar conductors 51. In the circulator 54, the millimeter wave signals inputted into one connection portion are outputted from the other connection portion that is adjacent in clockwise or counter-clockwise circulation within the plane of the ferrite disk. Moreover, the parallel planar conductor 51 has a magnet provided in part of its outer principal surface which corresponds to the ferrite disk so as to rotate a surface of an electromagnetic wave transmitted through the ferrite disk. The magnet is so arranged that the magnetic lines of force travel in a direction substantially perpendicular (vertical) to the ferrite disk. In the invention, the ferrite plate is not limited to a disk shape, but may be of a polygonal shape.

As another embodiment of the invention, FIG. 3 shows a millimeter wave transmitting/receiving apparatus of the type in which a transmitting antenna and a receiving antenna are provided independently. In FIG. 3, the millimeter wave radar includes: a pair of parallel planar conductors 61; a millimeter wave signal oscillator 62; a first dielectric strip 63; a circulator 64; a third dielectric strip 65; a transmitting antenna 66; a fifth dielectric strip 67; a second dielectric strip 68; a fourth dielectric strip 69; a receiving antenna 70; a mixer 71; and a mixer portion M2. In FIG. 3, for easy understanding, only one of the parallel planar conductors 61 is illustrated, but the other one has been omitted from the figure. The parallel planar conductor 61 corresponds to the parallel planar conductors 1 and 3 shown in FIG. 1.

The millimeter wave signal oscillator 62 is built as a voltage-controlled oscillator. The millimeter wave signal oscillator 62 is provided at one end of the first dielectric strip 63 and has a high-frequency diode oscillator. Moreover, a variable capacitance diode is arranged in the first dielectric strip 63 near the high-frequency diode, such that a direction in which a bias voltage is applied (bias voltage application direction) coincides with the electric field direction of the high-frequency signal. In the millimeter wave signal oscillator 62, by periodically controlling the bias voltage of the variable capacitance diode, a triangular or sinusoidal wave is formed, and thereby the millimeter wave signal fed from the high-frequency diode oscillator is outputted as a frequency-modulated transmission millimeter wave signal.

The first dielectric strip 63 has at its one end a high-frequency diode oscillator to transmit the transmission millimeter wave signal obtained by modulating the millimeter wave signal outputted from the high-frequency diode oscillator. The circulator 64 is made for example of a ferrite disk and has a first, a second, and a third connection portion 64*a*, 64*b*, and 64*c* that are respectively connected to the first, third, and fifth dielectric strips 63, 65, and 67. The third dielectric strip 65 is connected to the second connection portion 64*b* of the circulator 64 and has a transmitting antenna 66 disposed at its front end. The third dielectric strip 65 transmits the millimeter wave signals. The transmitting antenna 66 is realized by, for example, tapering the front end of the third dielectric strip 65. The fifth dielectric strip 67 is connected to the third connection portion 64*c* of the circulator 64, and has at its front end a non-reflective terminal end 67*a* for attenuating the transmission millimeter wave signals.

The second dielectric strip 68 is arranged near the first dielectric strip 63 so that its one end is electromagnetically coupled to the first dielectric strip 63. The second dielectric strip 68 transmits part of the millimeter wave signal toward the mixer 71. The non-reflective terminal end 68*a* is arranged at one end of the second dielectric strip 68 that is away from the mixer 71. The fourth dielectric strip 69 transmits waves that have been received by the receiving antenna 70 toward the mixer 71. The receiving antenna 70 is realized by, for example, tapering the front end of the fourth dielectric strip 69. The mixer portion M2 is realized by placing an intermediate portion of the second dielectric strip 68 near an intermediate portion of the fourth dielectric strip 69 so that the second and fourth dielectric strips are electromagnetically coupled to each other. The mixer portion M2 generates an intermediate frequency signal by mixing part of the millimeter wave signal and a received wave.

For example, the transmitting antenna 66 and the receiving antenna 70 may be each built as a horn antenna which inputs and outputs high-frequency signals through a through hole formed in the parallel planar conductors 61. The horn antenna is disposed on the outer surface of the parallel planar conductor 61 via a metal waveguide connected to the through hole.

In the invention, as shown in FIG. 2, the second dielectric strip 58 has its one end disposed near the first dielectric strip 53 so as to be electromagnetically coupled, or joined to the first dielectric strip 53. To join the first and second dielectric strips 53 and 58 together, it is preferable that the joint portion of the first dielectric strip 53 is linear-shaped and that of the second dielectric strip 58 is arc-shaped, and that the radius of curvature r of the arc-shaped portion is set to be equal or greater than the wavelength λ of the high-frequency signal. This makes it possible to branch the high-frequency signal with low loss and uniform output. It is also preferable that the joint portion of the second dielectric strip 58 is linear-shaped and that of the first dielectric strip 53 is arc-shaped, and that the radius of curvature r of the arc-shaped portion is set to be equal or greater than the wavelength λ of the high-frequency signal. Also in the latter case, substantially the same effects as achieved in the former case can be attained.

Moreover, in the mixer 59, the second dielectric strip 58 and the fourth dielectric strip 57 may be joined together. In this case, likewise as the above, the joint portion of either one of the dielectric strips 58 and 57 should preferably be arc-shaped, and the radius of curvature r of the arc-shaped portion should preferably be equal or greater than the wavelength λ of the high-frequency signal. In order for the second dielectric strip 58 to be arranged near the fourth dielectric strip 57 so that they are electromagnetically coupled to each other, the joint portion of either one of the second and fourth dielectric strips 58 and 57 should preferably be arc-shaped. In this way, the two dielectric strips are maintained in a proximate arrangement.

It is desirable that the radius of curvature r of the joint portion is set at 3 λ or less. If the radius of curvature r exceeds 3 λ, the coupling structure becomes unduly large. This makes miniaturization impossible. If the radius of curvature r is set to be smaller than the wavelength, the branch strength with respect to the dielectric strip having an arc-shaped joint portion becomes smaller.

Note that the coupling structure of the first and second dielectric strips 53 and 58, the coupling structure of the second and fourth dielectric strips 58 and 57, and the proximate arrangement structure of the second and fourth dielectric strips 58 and 57 are also applicable to the construction shown in FIG. 3.

These various components are provided between the parallel planar conductors arranged at an interval of 1/2 or below of the wavelength λ of the millimeter wave signal.

Figure 5:
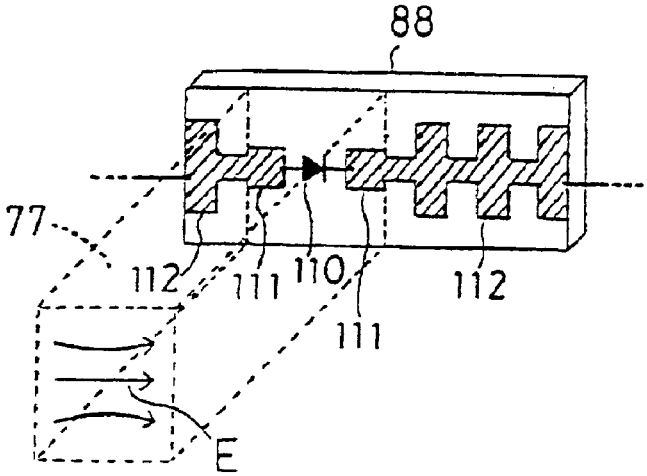
FIG. 5 is a perspective view showing a wiring board having a variable capacitance diode to be incorporated into the millimeter wave oscillator shown in FIG. 4.

In the millimeter wave radar shown in FIG. 2, it is possible to provide a switch at an intermediate portion of the first dielectric strip 53. By turning on or off the switch, pulse modulation is controlled. For example, as shown in FIG. 5, such a switch can be made by forming a second choke-type bias supply strip 112 on a principal surface of a wiring board 88, and providing a soldered beam lead PIN diode or a Schottky barrier diode partway along the second choke-type bias supply strip 112. In FIG. 5, symbol E represents the electric field direction of the high-frequency signal propagating through the dielectric strip 77.

The wiring board 88 is interposed on the way of the first dielectric strip 53, between the circulator 54 and the signal branching portion of the first dielectric strip 53 with respect to the second dielectric strip 58, such that the direction of the electric field of the LSM-mode high-frequency signal coincides with the bias voltage application direction of the pulse modulation diode, that is, the PIN diode or the Schottky barrier diode. A switch can also be realized by providing an additional circulator in the first dielectric strip 53, connecting the first dielectric strip 53 to the first and third connection portions of this circulator, connecting another dielectric strip to its second connection portion, and providing the Schottky barrier diode as shown in FIG. 5 at the end face of the front end portion of the dielectric strip.

Figure 4:
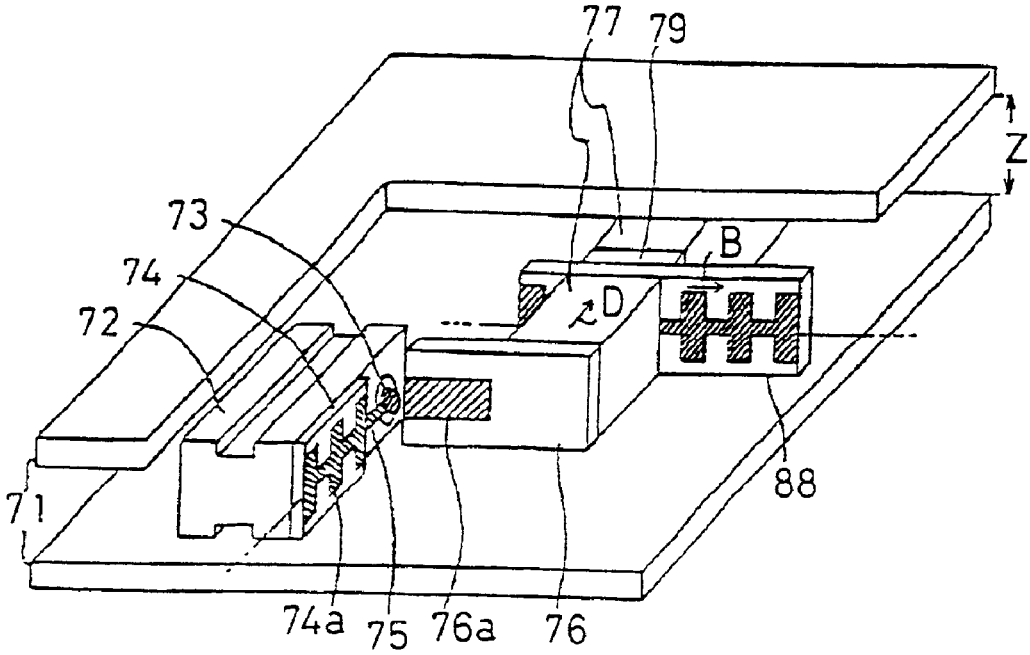
FIG. 4 is a perspective view showing a millimeter wave oscillator for use in the millimeter wave radar according to the invention.

It is also possible to eliminate the circulator 64 in the millimeter wave radar shown in FIG. 3, and to connect the transmitting antenna 66 to the front end of the first dielectric strip 63. In that case, the system can be made compact, but part of the received wave is fed into the voltage-controlled oscillator (millimeter wave signal oscillator) 62, which tends to cause noise. Therefore, the construction shown in FIG. 4 is preferable.

In the millimeter wave radar shown in FIG. 3, the second dielectric strip 68 may be arranged near the third dielectric strip 65 such that its one end is electromagnetically coupled, or joined to the third dielectric strip 65, so that part of the millimeter wave signal is transmitted toward the mixer 71. Also in this structure, it is possible to achieve the same capability and operational effects as achieved in the millimeter wave radar shown in FIG. 3.

In the millimeter wave radar shown in FIG. 3, it is possible to provide a switch as shown in FIG. 5 at an intermediate portion of the first dielectric strip 63. By turning on or off the switch, pulse modulation is controlled. For example, as shown in FIG. 5, such a switch can be made by forming a second choke-type bias supply strip 112 on a principal surface of a wiring board 88, and providing a soldered beam lead PIN diode or a Schottky barrier diode partway along the second choke-type bias supply strip 112. The wiring board 88 is interposed on the way of the first dielectric strip 63, between the circulator 64 and the signal branching portion of the first dielectric strip 63 with respect to the second dielectric strip 68, such that the direction of the electric field of the LSM-mode high-frequency signal coincides with the bias voltage application direction of the PIN diode or the Schottky barrier diode.

A switch can also be realized by providing an additional circulator in the first dielectric strip 63, connecting the first dielectric strip 63 to the first and third connection portions of this circulator, connecting another dielectric strip to its second connection portion, and providing the Schottky barrier diode as shown in FIG. 5 at the end face of the front end portion of the dielectric strip.

In these millimeter wave transmitting/receiving apparatuses, the distance between the parallel planar conductors is equal to the wavelength of the millimeter wave signal in the air, and is set to be 1/2 or below of the wavelength λ at the usage frequency.

The millimeter wave transmitting/receiving apparatuses shown in FIGS. 2 and 3 are of the FMCW (Frequency Modulation Continuous Wave) type, whose operating principle is as follows. An input signal with, for example, a triangular voltage amplitude is fed into a MODIN terminal for modulation signal input of the voltage-controlled oscillator, and the output signal is frequency-modulated, producing a triangular sweep of the output frequency of the voltage-controlled oscillator, for example. Then, when the output signal (transmitted wave) is emitted from the transmitting/receiving antenna 56 and the transmitting antenna 66, if a target is present in front of the transmitting/receiving antenna 56 and the transmitting antenna 66, a reflected wave (received wave) is returned at a time difference corresponding to the round trip length for the propagation speed of the radio wave. The IFOUT terminal on the output side of the mixer 59, 71 then outputs the frequency difference of the transmitted wave and the received wave.

By analyzing the frequency components of the output frequency, for example, of the IFOUT terminal, it is possible to derive the distance from the equation: $Fif=4\ R\cdot fm\cdot \Delta f/c$ (with Fif: IF (Intermediate Frequency) output frequency; R: distance; fm: modulation frequency; Δf: frequency deviation; and c: speed of light.)

When applied to a millimeter wave radar for automobiles, in this construction, millimeter waves are irradiated toward obstacles or other automobiles near the automobile. Then, an intermediate frequency signal is obtained by merging a reflected wave with the original millimeter wave. By analyzing this intermediate frequency signal, it is possible to measure the distance to the obstacle or the other automobile and the travel speed thereof.

Now, a description will be given below as to the voltage-controlled oscillators 52 and 62 employing a high-frequency diode oscillator according to the invention. FIGS. 4 and 5 show the high-frequency diode oscillator of NRD guide type according to the invention. In these figures, the high-frequency diode oscillator includes: a pair of parallel planar conductors 71; a metal member 72; a Gunn diode 73; a wiring board 74; a band-shaped conductor 75; and a dielectric strip 77. The parallel planar conductors 71 correspond to pairs of parallel planar conductors 1 and 3, and 51 and 61 shown in FIGS. 1 to 3.

The metal member 72, composed of a metal block of a substantially rectangular parallelepiped shape or the like, is provided for placing (mounting) the Gunn diode 73. The Gunn diode 73 is one type of high-frequency diodes for generating micro or millimeter waves. The wiring board 74 is disposed on one side surface of the metal member 72. Formed on the wiring board 74 is a choke-type bias supply strip 74*a* which supplies a bias voltage to the Gunn diode 73 and functions as a lowpass filter for preventing leakage of high-frequency signals. The band-shaped conductor 75, composed of a metal foil ribbon or the like, connects the choke-type bias supply strip 74*a* and the upper conductor of the Gunn diode 73. The dielectric strip 77, disposed in the vicinity of the Gunn diode 73, receives high-frequency signals and transmits them to the outside. The dielectric strip 77 corresponds to the first dielectric strips 53 and 63 shown in FIGS. 2 and 3.

In FIG. 4, it is preferable that the choke-type bias supply strip 74*a* is designed such that the lengths of the wider and the narrower portions are each set at approximately λ/4, and that the length of the band-shaped conductor 75 is set at approximately {(3/4)+m}λ (wherein m is an integer of zero or above). Specifically, the length of the band-shaped conductor 75 should preferably be set at approximately 3λ/4 to {(3/4)+3}λ, more preferably, approximately 3λ/4, approximately {(3/4)+1}λ. If the value {(3/4)+3}λ is exceeded, the band-shaped conductor 75 has an unduly long length and thus tends to suffer from warp or distortion. This causes great variation in characteristics, such as oscillation frequency, among the diode oscillators and also causes various resonant modes. As a result, signals in a frequency different from the desired oscillation frequency are generated.

Here, it is essential only that the length of the band-shaped conductor 75 be set at approximately {(3/4)+m}λ. Because, even if the value of the length is slightly deviated from {(3/4)+m}λ, resonance is possible. For example, the length of the band-shaped conductor 75 may take a value 10 to 20% larger than {(3/4)+m}λ. In this case, it is considered that part of the length λ/4 of the first pattern of the choke-type bias supply strip 74*a* contiguous to the band-shaped conductor 75 contributes to occurrence of resonance. Therefore, the length of the band-shaped conductor 75 can vary in a range of plus or minus 20% of {(3/4)+m}λ. In the above construction, the band-shaped conductor 75 resonates high-frequency signals on its own. This eliminates the need to use a metal strip resonator 76 provided with a metal strip 76*a*.

It is preferable that the choke-type bias supply strip 74*a* and the band-shaped conductor 75 are made of Cu, Al, Au, Ag, W, Ti, Ni, Cr, Pd, Pt, or the like, and Cu and Ag are especially preferable with regard to their high electrical conductivity, and with regard to attaining low loss and high oscillation output.

Furthermore, the band-shaped conductor 75 is electromagnetically coupled to the metal member 72, leaving a predetermined distance to the surface of the metal member 72, and straddling the distance between the choke-type bias supply strip 74*a* and the Gunn diode 73. That is, one end of the band-shaped conductor 75 is connected, for example by soldering, to one end of the choke-type bias supply strip 74*a*, and the other end of the band-shaped conductor 75 is connected, for example by soldering, to the upper conductor of the Gunn diode 73, so that the intermediate portion of the band-shaped conductor 75, apart from its connection portions, is arranged free in a suspended fashion.

Any metal conductor that can serve as electrical ground for the Gunn diode 73 may be used for the metal member 72, and while there is no particular limitation to the material for the metal member 72, other than being made of metal (including alloys), it can be made of brass (Cu—Zn alloy), Al, Cu, SUS (stainless steel), Ag, Au, Pt, or the like. The metal member 72 may also be a metal block made entirely of metal, or an insulating substrate of ceramics or plastic or the like, that is entirely or partially plated with metal, or an insulating substrate that is entirely or partially coated with a conductive resin material.

The dielectric strip 77 corresponds to the first dielectric strips 53 and 63 shown in FIGS. 2 and 3. As described previously, preferable materials therefor include a cordierite ($2MgO.2Al_2O_3.5SiO_2$) ceramics (relative dielectric constant: 4 to 5), which is low loss in the high-frequency band. The distance between the Gunn diode 73 and the dielectric strip 77 should preferably be set at about 1.0 mm or below. If the distance exceeds 1.0 mm, it is impossible to achieve electromagnetic coupling with lower loss.

In the invention, as the high-frequency diode, microwave or millimeter wave diodes are preferably used, such as an impatt (impact ionisation avalanche transit time) diode, a trapatt (trapped plasma avalanche triggered transit) diode, or a Gunn diode.

The following is a description of working examples of the invention.

EXAMPLE 1

Figure 1:
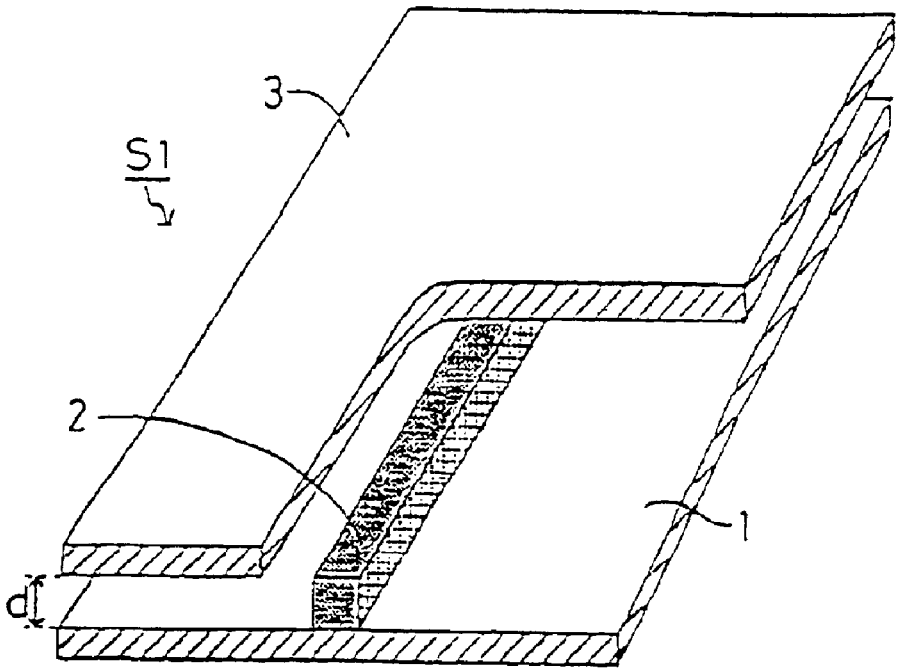
FIG. 1 is a perspective view showing the inner structure of the NRD guide according to the invention.

An NRD guide S1 as shown in FIG. 1 was constructed as follows. As materials for the dielectric strip 2, ceramics with varying composition ratios were prepared that include a complex oxide comprising Mg, Al and Si as a main component. Their relative dielectric constants and Q values at a frequency of 60 GHz will be shown in Table 1.

TABLE 1

| | Composition (mol %) | | | | | Relative dielectric | Q value |
|---|---|---|---|---|---|---|---|
| | MgO | Al2O3 | SiO2 | Additive | (wt %) | constant | (60 GHz) |
| 1 | 5 | 55 | 40 | Yb2O3 | 10 | 6.8 | 520 |
| 2 | 10 | 10 | 80 | Yb2O3 | 10 | 4.8 | 1400 |
| 3 | 10 | 30 | 60 | Yb2O3 | 15 | 5.8 | 1820 |
| 4 | 10 | 40 | 50 | Yb2O3 | 0.1 | 5.8 | 1850 |
| 5 | 15 | 35 | 50 | Yb2O3 | 5 | 5.6 | 2121 |
| 6 | 17.5 | 17.5 | 65 | Yb2O3 | 5 | 4.8 | 2040 |
| 7 | 20 | 40 | 40 | Yb2O3 | 5 | 5.6 | 1010 |
| 8 | 22.2 | 22.2 | 55.6 | — | — | 4.7 | 2810 |
| 9 | 25 | 17 | 58 | Yb2O3 | 10 | 5.1 | 2490 |
| 10 | 25 | 27 | 48 | Yb2O3 | 10 | 5.6 | 2770 |
| 11 | 25.5 | 30 | 44.5 | Yb2O3 | 10 | 5.8 | 2120 |
| 12 | 30 | 10 | 60 | Yb2O3 | 5 | 5.2 | 1500 |
| 13 | 30 | 30 | 40 | Yb2O3 | 5 | 5.6 | 2500 |
| 14 | 35 | 20 | 45 | Yb2O3 | 10 | 6.0 | 2060 |
| 15 | 35 | 35 | 30 | Yb2O3 | 0.1 | 5.8 | 2080 |
| 16 | 40 | 10 | 50 | Yb2O3 | 10 | 5.8 | 1990 |
| 17 | 40 | 20 | 40 | Yb2O3 | 5 | 5.5 | 1020 |
| 18 | 40 | 40 | 20 | Yb2O3 | 10 | 6.0 | 1470 |
| 19 | 40 | 50 | 10 | Yb2O3 | 5 | 7.9 | 520 |
| 20 | 58 | 10 | 32 | Yb2O3 | 5 | 7.5 | 1250 |
| 21 | 22.2 | 22.2 | 55.6 | Yb2O3 | 0.1 | 4.8 | 2910 |
| 22 | 22.2 | 22.2 | 55.6 | Yb2O3 | 1 | 4.8 | 2670 |
| 23 | 22.2 | 22.2 | 55.6 | Yb2O3 | 5 | 4.8 | 2750 |
| 24 | 22.2 | 22.2 | 55.6 | Yb2O3 | 7 | 4.9 | 3010 |
| 25 | 22.2 | 22.2 | 55.6 | Yb2O3 | 10 | 5.0 | 3010 |
| 26 | 22.2 | 22.2 | 55.6 | Yb2O3 | 15 | 5.4 | 2100 |
| 27 | 22.2 | 22.2 | 55.6 | Y2O3 | 10 | 5.0 | 2900 |
| 28 | 22.2 | 22.2 | 55.6 | La2O3 | 10 | 5.0 | 2930 |
| 29 | 22.2 | 22.2 | 55.6 | Nd2O3 | 10 | 5.0 | 2870 |
| 30 | 22.2 | 22.2 | 55.6 | Er2O3 | 10 | 5.0 | 2910 |
| 31 | 22.2 | 22.2 | 55.6 | Lu2O3 | 10 | 5.0 | 2990 |
| 32 | 22.2 | 22.2 | 55.6 | Sc2O3 | 10 | 5.0 | 2790 |
| 33 | 22.2 | 22.2 | 55.6 | BaO | 10 | 4.9 | 2500 |
| 34 | 22.2 | 22.2 | 55.6 | SrO | 10 | 4.9 | 2890 |
| 35 | 22.2 | 22.2 | 55.6 | CaO | 10 | 4.9 | 2470 |
| 36 | 22.2 | 22.2 | 55.6 | NiO | 10 | 5.0 | 2880 |
| 37 | 22.2 | 22.2 | 55.6 | CoO | 10 | 5.0 | 2790 |
| 38 | 22.2 | 22.2 | 55.6 | In2O3 | 10 | 5.0 | 2960 |
| 39 | 22.2 | 22.2 | 55.6 | GaO2 | 10 | 5.0 | 2850 |
| 40 | 22.2 | 22.2 | 55.6 | TiO2 | 10 | 5.0 | 2760 |
| 41 | 22.2 | 22.2 | 55.6 | Si3N4 | 10 | 4.9 | 2840 |

A pair of parallel planar conductors 1 and 3, each of which is made of an aluminum metal plate which is 80 mm long, 80 mm wide, and 2 mm in thickness, were arranged in parallel at a distance d of 1.8 mm. A dielectric strip 2 made of the cordierite ceramics as numbered 24 in Table 1 was placed between the parallel planar conductors 1 and 3. The sectional configuration of the dielectric strip 2 assumes a rectangular shape with a height of about 1.8 mm and a width of about 0.8 mm. The dielectric strip 2 has a 0.1 mm-wide chamfer 2*a* (FIG. 7) formed at each edge portion. The surface roughness of the inner surface of the metal plate was measured by using a tracer-type surface roughness measuring machine, and the result was 0.3 $\mu$m. The metal plate and the dielectric strip 2 were bonded together with one-component epoxyresin. Transmission loss in high-frequency signals was measured by a network analyzer at a frequency of 76.5 GHz, and the result was 0.18 dB/cm. This means that the transmission loss is sufficiently small in practice.

Comparative Example 1

Another NRD guide S1 as shown in FIG. 1 was constructed basically in the same manner as in Example 1 except that, in the former, the dielectric strip 2 has a 0.35 mm-wide chamfer 2*a* formed at each edge portion. Transmission loss in high-frequency signals was measured and found to be as great as 0.4 dB/cm.

EXAMPLE 2

A pair of parallel planar conductors 1 and 3, each of which is made of an aluminum metal plate which is 80 mm long, 80 mm wide, and 2 mm in thickness, were arranged in parallel at a distance d of 1.8 mm. A dielectric strip 2 made of the cordierite ceramics as numbered 24 in Table 1 was placed between the parallel planar conductors 1 and 3. The sectional configuration of the dielectric strip 2 assumes a rectangular shape with a height of about 1.8 mm and a width of about 0.8 mm. The dielectric strip 2 had an open pore ratio of 0.5%. The surface roughness of the inner surface of the metal plate was measured by using a tracer-type surface roughness measuring machine, and the result was 0.3 $\mu$m. The metal plate and the dielectric strip 2 were bonded together with one-component epoxy resin. Transmission loss in high-frequency signals was measured by a network analyzer at a frequency of 76.5 GHz, and the result was 0.18 dB/cm. This means that the transmission loss is sufficiently small in practice.

Comparative Example 2

Another NRD guide S1 as shown in FIG. 1 was constructed basically in the same manner as in Example 2 except that, in the former, the dielectric strip 2 has an open pore ratio of 10%. Transmission loss in high-frequency signals was measured and found to be as great as 0.4 dB/cm.

EXAMPLE 3

Another NRD guide S1 as shown in FIG. 1 was constructed basically in the same manner as in Example 1 except that, in the former, at each edge portion of the dielectric strip 2 is formed a chamfer 2*a* forming a plane and having a width H of 0.1 mm with respect to the faces 2*c* opposing to the parallel planar conductors, and a width H1 of 0.05 mm with respect to the side faces 2*b* (H>H1), as shown in FIG. 7C. Transmission loss in high-frequency signals was measured and the result was 0.16 dB/cm, which means that the transmission loss is sufficiently small in practice.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A non-radiative dielectric waveguide comprising:

a pair of parallel planar conductors arranged at an interval of half or below of a high-frequency signal wavelength; and a dielectric strip interposed between the parallel planar conductors, the dielectric strip having a 0.01 to 0.3 mm-wide chamfer formed at an edge portion in a transmission direction of the dielectric strip;

wherein a surface of each parallel planar conductor adjacent to the dielectric strip is planar, and each parallel planar conductor and the dielectric strip are bonded with an adhesive so that a surface of the dielectric strip facing each parallel planar conductor and a chamfer adjacent to the surface of the dielectric strip are coupled to each parallel planar conductor.

2. A non-radiative dielectric waveguide comprising:

a pair of parallel planar conductors arranged at an interval of half or below of a high-frequency signal wavelength; and a dielectric strip interposed between the parallel planar conductors, the dielectric strip having a 0.01 to 0.3 mm-wide chamfer formed at an edge portion in a transmission direction of the dielectric strip;

wherein a surface of each parallel planar conductor adjacent to the dielectric strip is planar, wherein the chamfer is formed as a flat surface, and one width of the chamfer corresponding to a surface of the dielectric strip facing to the parallel planar conductor is made larger than the other width corresponding to a side surface of the dielectric strip.

3. A non-radiative dielectric waveguide comprising:

a pair of parallel planar conductors arranged at an interval of half or below of a high-frequency signal wavelength; and a dielectric strip interposed between the parallel planar conductors, the dielectric strip having a 0.01 to 0.3 mm-wide chamfer formed at an edge portion in a transmission direction of the dielectric strip;

wherein a surface of each parallel planar conductor adjacent to the dielectric strip is planar, wherein the chamfer is formed as a convexly-curved surface, and one width of the chamfer corresponding to the surface of the dielectric strip facing to the parallel planar conductor is made larger than the other width corresponding to the side surface of the dielectric strip.

4. A non-radiative dielectric waveguide comprising:

a pair of parallel planar conductors arranged at an interval of half or below of a high-frequency signal wavelength; and a dielectric strip interposed between the parallel planar conductors, the dielectric strip being made of a ceramics having an open pore ratio of 5% or less.

wherein a surface of each parallel planar conductor adjacent to the dielectric strip is planar.

5. The non-radiative dielectric waveguide of claim 4, wherein the dielectric strip has an open pore ratio of 3% or less.

6. A millimeter wave transmitting/receiving apparatus comprising:

a pair of parallel planar conductors arranged at an interval of half or below of a millimeter wave signal wavelength;

a first dielectric strip having at its one end a high-frequency diode oscillator, the first dielectric strip propagating a millimeter wave signal outputted from the high-frequency diode oscillator;

a variable capacitance diode for outputting the millimeter wave signal as a frequency modulated transmission millimeter wave signal, by periodically controlling a bias voltage of the variable capacitance diode, the variable capacitance diode being arranged such that a direction in which the bias voltage is applied coincides with a direction of an electric field of the millimeter wave signal;

a second dielectric strip, one end of the second dielectric strip being disposed near the first dielectric strip so as to be electromagnetically coupled, or being joined to the first dielectric strip, the second dielectric strip propagating part of the millimeter wave signal toward a mixer;

a circulator having a first connection portion, a second connection portion, and a third connection portion arranged at predetermined spacings along a perimeter of a ferrite disk arranged in parallel to the parallel planar conductors, the connection portions serving as input/output terminals for the millimeter wave signal, the circulator outputting the millimeter wave signal inputted into one of the connection portions from another connection portion that is adjacent in clockwise or counter-clockwise circulation within a plane of the ferrite disk, the first connection portion being connected to an output terminal of the millimeter wave signal of the first dielectric strip;

a third dielecric strip for propagating the millimeter wave signal, the third dielectric strip being joined to the second connection portion of the circulator and having a transmitting/receiving antenna disposed at its front end;

a fourth dielectric strip for propagating a received wave that is received by the transmitting/receiving antenna, propagated along the third dielectric strip, and outputted from the third connection portion of the circulator, toward the mixer; and a mixer portion for generating an intermediate frequency signal by mixing part of the millimeter wave signal and a received wave, the mixer being made by placing an intermediate portion of the second dielectric strip near an intermediate portion of the fourth dielectric strip so that the second and fourth dielectric strips are electromagnetically coupled to, or joined to each other, wherein the first, second, third, and fourth dielectric strips; the variable capacitance diode; the circulator; and the mixer portion are interposed between the parallel planar conductors, and wherein, of the first to fourth dielectric strips, at least one is a non-radiative dielectric waveguide of one of claims 1 to 5.

7. A millimeter wave transmitting/receiving apparatus comprising:

a pair of parallel planar conductors arranged at an interval of half or below of a millimeter wave signal wavelength;

a first dielectric strip having at its one end a high-frequency diode oscillator, the first dielectric strip propagating a millimeter wave signal outputted from the high-frequency diode oscillator;

a variable capacitance diode for outputting the millimeter wave signal as a frequency modulated transmission millimeter wave signal, by periodically controlling a bias voltage of the variable capacitance diode, the variable capacitance diode being arranged such that a direction in which the bias voltage is applied coincides with a direction of an electric field of the millimeter wave signal;

a second dielectric strip, one end of the second dielectric strip being disposed near the first dielectric strip so as to be electromagnetically coupled, or being joined to the first dielectric strip, the second dielectric strip propagating part of the millimeter wave signal toward a mixer;

a circulator having a first connection portion, a second connection portion, and a third connection portion arranged at predetermined spacings along a perimeter of a ferrite disk arranged in parallel to the parallel planar conductors, the connection portions serving as input/output terminals for the millimeter wave signal, the circulator outputting the millimeter wave signal inputted into one of the connection portions from another connection portion that is adjacent in clockwise or counter-clockwise circulation within a plane of the ferrite disk, the first connection portion being connected to an output terminal of the millimeter wave signal of the first dielectric strip;

a third dielectric strip for propagating the millimeter wave signal, the third dielectric strip being connected to the second connection portion of the circulator and having a transmitting antenna disposed at its front end;

a fourth dielectric strip having at its front end a receiving antenna and having its other end a mixer;

a fifth dielectric strip connected to the third connection portion of the circulator, the fifth dielectric strip propagating a millimeter wave signal received and mixed with the transmitting antenna and attenuating the millimeter wave signal at a non-reflective terminal end disposed at a front end of the fifth dielectric strip; and a mixer portion for generating an intermediate frequency signal by mixing part of the millimeter wave signal and a received wave, the mixer being made by placing an intermediate portion of the second dielectric strip near an intermediate portion of the fourth dielectric strip so that the second and fourth dielectric strips are electromagnetically coupled to, or joined to each other, wherein the first, second, third, fourth, and fifth dielectric strips; the variable capacitance diode; the circulator; and the mixer portion are interposed between the parallel planar conductors, and wherein, of the first to fifth dielectric strips, at least one is a non-radiative dielectric wave guide of one of claims 1 to 5.

8. A non-radiative dielectric waveguide comprising:

a pair of parallel planar conductors arranged at an interval of half or below of a high-frequency signal wavelength; and a dielectric strip interposed between the parallel planar conductors, the dielectric strip having a 0.01 to 0.3 mm-wide chamfer formed at an edge portion in a transmission direction of the dielectric strip;

wherein a surface of each parallel planar conductor adjacent to the dielectric strip is planar, wherein the dielectric strip is made of a ceramics including a complex oxide comprising Mg, Al and Si as a main component and having a Q value of 1000 or above at a measured frequency of 60 GHz.

9. A non-radiative dielectric waveguide comprising:

a pair of parallel planar conductors arranged at an interval of half or below of a high-frequency signal wavelength; and a dielectric strip interposed between the parallel planar conductors, the dielectric strip having a 0.01 to 0.3 mm-wide chamfer formed at an edge portion in a transmission direction of the dielectric strip;

wherein a surface of each parallel planar conductor adjacent to the dielectric strip is planar, wherein the chamfer is formed as a flat surface, and one width of the chamfer corresponding to a surface of the dielectric strip facing to the parallel planar conductor is made larger than the other width corresponding to a side surface of the dielectric strip;

wherein the dielectric strip is made of a ceramics including a complex oxide comprising Mg, Al and Si as a main component and having a Q value of 1000 or above at a measured frequency of 60 GHz.

10. The non-radiative dielectric waveguide of claim 9, wherein the composition of the complex oxide by mole ratio is expressed by the following formula: $xMgO.yAl_2O_3.zSiO_2$ (wherein x, y and z are numbers satisfying the x+y+z=100 mole %, x representing 10 to 40 mole %, y representing 10 to 40 mole %, and z representing 20 to 80 mole %).

11. A non-radiative dielectric waveguide comprising:

a pair of parallel planar conductors arranged at an interval of half or below of a high-frequency signal wavelength; and a dielectric strip interposed between the parallel planar conductors, the dielectric strip having a 0.01 to 0.3 mm-wide chamfer formed at an edge portion in a transmission direction of the dielectric strip;

wherein a surface of each parallel planar conductor adjacent to the dielectric strip is planar, wherein the chamfer is formed as a convexly-curved surface, and one width of the chamfer corresponding to a surface of the dielectric strip facing to the parallel planar conductor is made larger than the other width corresponding to the side surface of the dielectric strip;

wherein the dielectric strip is made of a ceramics including a complex oxide comprising Mg, Al and Si as a main component and having a Q value of 1000 or above at a measured frequency of 60 GHz.

12. The non-radiative dielectric waveguide of claim 11, wherein the composition of the complex oxide by mole ratio is expressed by the following formula: $xMgO.yAl_2O_3.zSiO_2$ (wherein x, y and z are numbers satisfying the x+y+z=100 mole %, x representing 10 to 40 mole %, y representing 10 to 40 mole %, and z representing 20 to 80 mole %).

13. A non-radiative dielectric waveguide comprising:

a pair of parallel planar conductors arranged at an interval of half or below of a high-frequency signal wavelength; and a dielectric strip interposed between the parallel planar conductors, the dielectric strip being made of a ceramics having an open pore ratio of 5% or less;

wherein a surface of each parallel planar conductor adjacent to the dielectric strip is planar, wherein the dielectric strip is made of a ceramics including a complex oxide comprising Mg, Al and Si as a main component and having a Q value of 1000 or above at a measured frequency of 60 GHz.

14. The non-radiative dielectric waveguide of claim 13, wherein the composition of the complex oxide by mole ratio is expressed by the following formula: $xMgO.yAl2O_3.zSiO_2$ (wherein x, y and z are numbers satisfying the x+y+z=100 mole %, x representing 10 to 40 mole %, y representing 10 to 40 mole %, and z representing 20 to 80 mole %).

15. A non-radiative dielectric waveguide comprising:

a pair of parallel planar conductors arranged at an interval of half or below of a high-frequency signal wavelength; and a dielectric strip interposed between the parallel planar conductors, the dielectric strip being made of a ceramics having an open pore ratio of 5% or less;

wherein a surface of each parallel planar conductor adjacent to the dielectric strip is planar, wherein the dielectric strip has an open pore ratio of 3% or less;

wherein the dielectric strip is made of a ceramics including a complex oxide comprising Mg, Al and Si as a main component and having a Q value of 1000 or above at a measured frequency of 60 GHz.

16. The non-radiative dielectric waveguide of claim 15, wherein the composition of the complex oxide by mole ratio is expressed by the following formula: $xMgO.yAl_2O_3.zSiO_2$ (wherein x, y and z are numbers satisfying the x+y+z=100 mole %, x representing 10 to 40 mole %, y representing 10 to 40 mole %, and z representing 20 to 80 mole %).

17. The non-radiative dielectric waveguide of claim 8, wherein the composition of the complex oxide by mole ratio is expressed by the following formula: $xMgO.yAl_2O_3.zSiO_2$ (wherein x, y and z are numbers satisfying the x+y+z=100 mole %, x representing 10 to 40 mole %, y representing 10 to 40 mole %, and z representing 20 to 80 mole %).

18. A millimeter wave transmitting/receiving apparatus comprising:

a pair of parallel planar conductors arranged at an interval of half or below of a millimeter wave signal wavelength;

a first dielectric strip having at its one end a high-frequency diode oscillator, the first dielectric strip propagating a millimeter wave signal outputted from the high-frequency diode oscillator;

a variable capacitance diode for outputting the millimeter wave signal as a frequency modulated transmission millimeter wave signal, by periodically controlling a bias voltage of the variable capacitance diode, the variable capacitance diode being arranged such that a direction in which the bias voltage is applied coincides with a direction of an electric field of the millimeter wave signal;

a second dielectric strip, one end of the second dielectric strip being disposed near the first dielectric strip so as to be electromagnetically coupled, or being joined to the first dielectric strip, the second dielectric strip propagating part of the millimeter wave signal toward a mixer;

a circulator having a first connection portion, a second connection portion, and a third connection portion arranged at predetermined spacings along a perimeter of a ferrite disk arranged in parallel to the parallel planar conductors, the connection portions serving as input/output terminals for the millimeter wave signal, the circulator outputting the millimeter wave signal inputted into one of the connection portions from another connection portion that is adjacent in clockwise or counter-clockwise circulation within a plane of the ferrite disk, the first connection portion being connected to an output terminal of the millimeter wave signal of the first dielectric strip;

a third dielectric strip for propagating the millimeter wave signal, the third dielectric strip being joined to the second connection portion of the circulator and having a transmitting/receiving antenna disposed at its front end;

a fourth dielectric strip for propagating a received wave that is received by the transmitting/receiving antenna, propagated along the third dielectric strip, and outputted from the third connection portion of the circulator, toward the mixer; and a mixer portion for generating an intermediate frequency signal by mixing part of the millimeter wave signal and a received wave, the mixer being made by placing an intermediate portion of the second dielectric strip near an intermediate portion of the fourth dielectric strip so that the second and fourth dielectric strips are electromagnetically coupled to, or joined to each other, wherein the first, second, third, and fourth dielectric strips; the variable capacitance diode; the circulator; and the mixer portion are interposed between the parallel planar conductors, and wherein, of the first to fourth dielectric strips, at least one is a non-radiative dielectric waveguide of one of claims 8 to 16.

19. A millimeter wave transmitting/receiving apparatus comprising:

a pair of parallel planar conductors arranged at an interval of half or below of a millimeter wave signal wavelength;

a first dielectric strip having at its one end a high-frequency diode oscillator, the first dielectric strip propagating a millimeter wave signal outputted from the high-frequency diode oscillator;

a variable capacitance diode for outputting the millimeter wave signal as a frequency modulated transmission millimeter wave signal, by periodically controlling a bias voltage of the variable capacitance diode, the variable capacitance diode being arranged such that a direction in which the bias voltage is applied coincides with a direction of an electric field of the millimeter wave signal;

a second dielectric strip, one end of the second dielectric strip being disposed near the first dielectric strip so as to be electromagnetically coupled, or being joined to the first dielectric strip, the second dielectric strip propagating part of the millimeter wave signal toward a mixer;

a circulator having a first connection portion, a second connection portion, and a third connection portion arranged at predetermined spacings along a perimeter of a ferrite disk arranged in parallel to the parallel planar conductors, the connection portions serving as input/output terminals for the millimeter wave signal, the circulator outputting the millimeter wave signal inputted into one of the connection portions from another connection portion that is adjacent in clockwise or counter-clockwise circulation within a plane of the ferrite disk, the first connection portion being connected to an output terminal of the millimeter wave signal of the first dielectric strip;

a third dielectric strip for propagating the millimeter wave signal, the third dielectric strip being connected to the second connection portion of the circulator and having a transmitting antenna disposed at its front end;

a fourth dielectric strip having at its front end a receiving antenna and having its other end a mixer;

a fifth dielectric strip connected to the third connection portion of the circulator, the fifth dielectric strip propagating a millimeter wave signal received and mixed with the transmitting antenna and attenuating the millimeter wave signal at a non-reflective terminal end disposed at a front end of the fifth dielectric strip; and a mixer portion for generating an intermediate frequency signal by mixing part of the millimeter wave signal and a received wave, the mixer being made by placing an intermediate portion of the second dielectric strip near an intermediate portion of the fourth dielectric strip so that the second and fourth dielectric strips are electromagnetically coupled to, or joined to each other, wherein the first, second, third, fourth, and fifth dielectric strips; the variable capacitance diode; the circulator; and the mixer portion are interposed between the parallel planar conductors, and wherein, of the first to fifth dielectric strips, at least one is a non-radiative dielectric waveguide of one of claims 8 to 16.

* * * * *